US009272550B2

(12) United States Patent
Ito et al.

(10) Patent No.: US 9,272,550 B2
(45) Date of Patent: Mar. 1, 2016

(54) IMAGE FORMING APPARATUS

(71) Applicants: Yoichi Ito, Tokyo (JP); Mikio Ohashi, Kanagawa (JP); Soyoung Park, Kanagawa (JP); Yoshinori Uchino, Kanagawa (JP)

(72) Inventors: Yoichi Ito, Tokyo (JP); Mikio Ohashi, Kanagawa (JP); Soyoung Park, Kanagawa (JP); Yoshinori Uchino, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/636,879

(22) Filed: Mar. 3, 2015

(65) Prior Publication Data

US 2015/0251467 A1 Sep. 10, 2015

(30) Foreign Application Priority Data

Mar. 10, 2014 (JP) ..... 2014-046013
Mar. 15, 2014 (JP) ..... 2014-052847

(51) Int. Cl.

| | |
|---|---|
| ***B41J 25/312*** | (2006.01) |
| ***B41J 25/308*** | (2006.01) |
| ***B41J 19/20*** | (2006.01) |
| ***B41J 2/045*** | (2006.01) |
| ***B41J 25/00*** | (2006.01) |

(52) U.S. Cl.

CPC ..... *B41J 19/207* (2013.01); *B41J 2/04556* (2013.01); *B41J 2/04586* (2013.01); *B41J 25/003* (2013.01); *B41J 25/308* (2013.01)

(58) Field of Classification Search

CPC ..... B41J 11/005; B41J 11/0045; B41J 13/10; B41J 13/14; B41J 13/16; B41J 13/24; B41J 17/20; B41J 17/16; B41J 25/312; B41J 25/304; B41J 25/308; B41J 25/3084; B41J 11/0005; B41J 25/3086; B41J 25/3088

USPC ..... 347/19, 37, 101, 104

See application file for complete search history.

(56) References Cited

U.S. PATENT DOCUMENTS 5,534,902 A * 7/1996 Hoesly ..... 347/104
2008/0265496 A1* 10/2008 Kawaguchi et al. ..... 271/227

FOREIGN PATENT DOCUMENTS

EP 1174276 A1 * 1/2002

* cited by examiner

*Primary Examiner* — Geoffrey Mruk
*Assistant Examiner* — Scott A Richmond
(74) *Attorney, Agent, or Firm* — Cooper & Dunham LLP

(57) ABSTRACT

An image forming apparatus includes an image forming unit to form an image on a medium; a reciprocally moving carriage on which to mount the image forming unit; a carriage position detector to detect a position of the carriage; a conveyance unit to convey the medium; a conveyance path of the medium; a regulator to regulate a distance between the medium and the image forming unit and movable in a moving direction of the carriage; a regulator detector, mounted on the carriage, to detect the regulator; a drive unit to move the regulator; and a controller that controls a position of the regulator based on a reading from the carriage position when the regulator detector detects the regulator.

5 Claims, 17 Drawing Sheets

IMAGE FORMING APPARATUS

CROSS-REFERENCE TO RELATED APPLICATIONS

The present application claims priority pursuant to 35 U.S.C. §119(a) from Japanese patent application numbers 2014-046013 and 2014-052847, filed on Mar. 10, 2014 and Mar. 15, 2014, respectively, the entire disclosures of which are incorporated by reference herein.

BACKGROUND

1. Technical Field

Exemplary embodiments of the present invention relate to an image forming apparatus.

2. Background Art

As an image forming apparatus such as a printer, a facsimile machine, a copier, a plotter, and a multifunction apparatus combining capabilities of the above devices, an inkjet recording apparatus employing a recording head formed of liquid droplet discharging head (or a droplet discharge head) is known.

In particular, an image forming apparatus is known that has a platen to guide a print medium opposing an image forming unit, a guide member to guide the print medium conveyed along the platen, and a biasing member that is movable in a direction perpendicular to the direction in which the medium is conveyed.

SUMMARY

In one embodiment of the disclosure, there is provided an improved image forming apparatus that includes an image forming unit to form an image on a medium; a reciprocally moving carriage on which to mount the image forming unit; a carriage position detector to detect a position of the carriage; a conveyance unit to convey the medium opposing the image forming unit; a conveyance path of the medium; a regulator to regulate a distance between the medium and the image forming unit, disposed between the image forming unit and the conveyance path of the medium and movable in a moving direction of the carriage; and a regulator detector, mounted on the carriage, to detect the regulator; a drive unit to move the regulator; and a controller that controls a position of the regulator based on a reading of the carriage position when the regulator detector detects the regulator.

In one embodiment of the disclosure, there is provided an improved image forming apparatus including an image forming unit to form an image on a medium; a reciprocally moving carriage on which to mount the image forming unit; a conveyance unit to move the medium opposing the image forming unit; a plurality of regulators to regulate a distance between the medium and the image forming unit, each disposed between the image forming unit and a conveyance path of the medium and movable in a moving direction of the carriage; a media sensor to detect an edge of the medium in the moving direction of the carriage; and a controller that moves the regulator based on the edge of the medium detected by the media sensor.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

A first embodiment according to the present invention will be described with reference to FIGS. 1 and 2.

Figure 1:
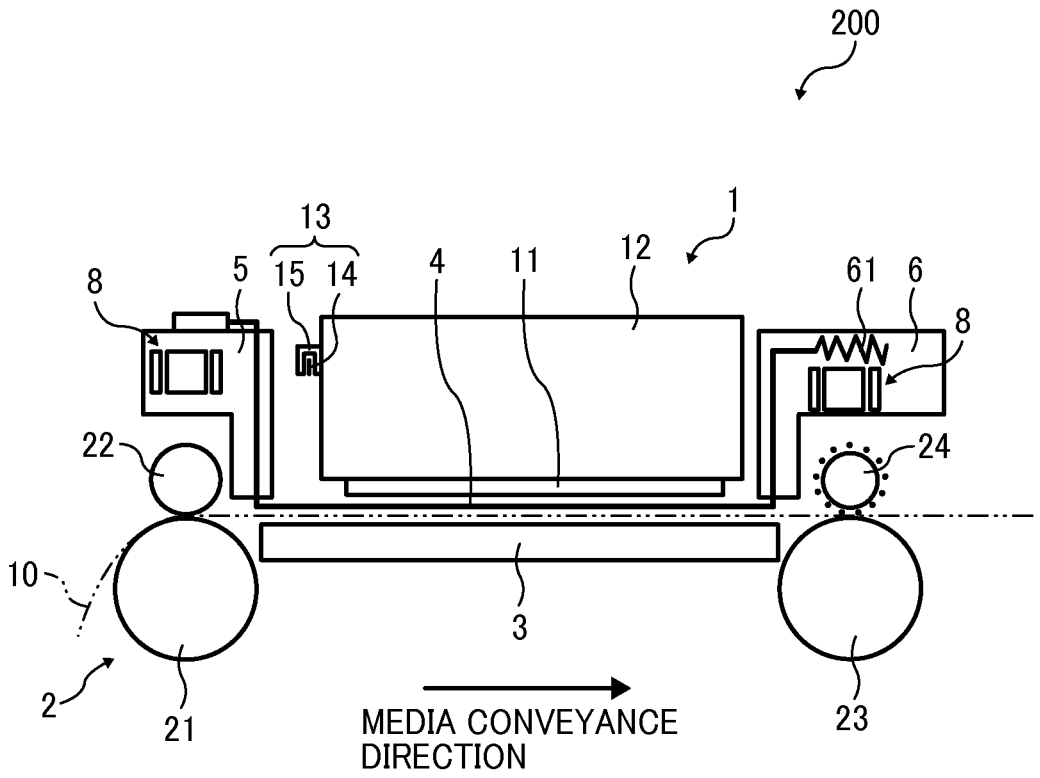
FIG. 1 is a schematic perspective view of an image forming apparatus according to a first embodiment of the present invention.
Figure 2:
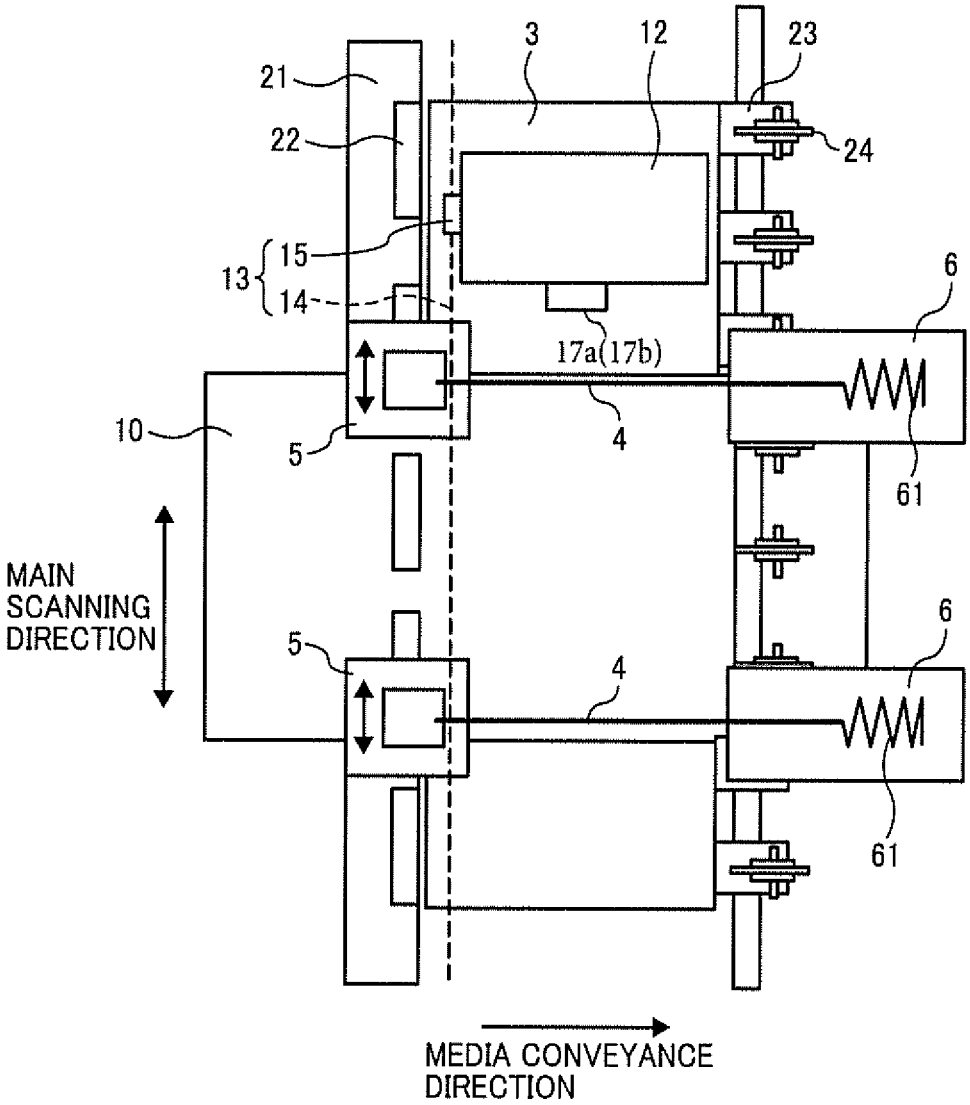
FIG. 2 is an explanatory plan view of the image forming apparatus of FIG. 1.

FIG. 1 is a schematic perspective view of an image forming apparatus and FIG. 2 is an explanatory plan view of the image forming apparatus of FIG. 1.

The present image forming apparatus 200 includes an image forming unit 1 to form an image on a medium 10 and a conveyance unit 2 to convey the medium 10 opposing the image forming unit 1.

The image forming unit 1 includes a recording head 11 formed of droplet discharge head that discharges droplets; and a carriage 12 on which the recording head 11 is mounted. The carriage 12 is movably held by a guide member and moves reciprocally in a main scanning direction as illustrated in FIG. 2. The main scanning direction is a direction perpendicular to a media conveyance direction.

The conveyance unit 2 includes a pair of a conveyance roller 21 and a pressure roller 22 disposed upstream of the recording head 11 in the media conveyance direction, and a pair of a sheet discharge roller 23 and a spurring roller 24 disposed downstream of the recording head 11 in the media conveyance direction.

A platen 3 serving as a conveyance guide member to guide the medium 10 is disposed opposite the recording head 11 and between the pair of the conveyance roller 21 and the pressure roller 22 and the pair of the sheet discharge roller 23 and the spurring roller 24. The surface of the platen 3 forms a conveyance path of the medium 10. Alternatively, a belt may be used instead of the platen 3 to form the conveyance path.

A regulator 4 is disposed between the recording head 11 and the platen 3 that forms a conveyance path of the medium 10. The regulator 4 regulates a distance between the medium 10 and the recording head 11 by suppressing the medium 10. The regulator 4 is formed of threadlike member such as a gut or a thin layer member such as a PET film.

The regulator 4 is supported by an upstream supporter 5 disposed upstream of the recording head 11 in a media conveyance direction and a downstream supporter 6 disposed downstream of the regulator 4 in the media conveyance direction. A tensioner 61 to apply tension to the regulator 4 is disposed at the downstream supporter 6.

Herein, the upstream supporter 5, the downstream supporter 6, and the regulator 4 are provided in pairs to regulate lateral edges of the medium 10. As illustrated in FIG. 2, the width direction is a main scanning direction perpendicular to the media conveyance direction. The upstream supporter 5 and the downstream supporter 6 each are movably disposed in the main scanning direction along which the carriage 12 moves.

In addition, an encoder sheet 14 to detect a position of the carriage 12 is disposed along the main scanning direction. The carriage 12 includes an encoder sensor 15 to read the encoder sheet 14. A linear encoder 13 serving as a carriage position detector is formed of the encoder sheet 14 and the encoder sensor 15. The carriage position can be detected from a rotation amount of the motor to move the carriage 12.

The carriage 12 further includes a regulator detector 17*a* to detect the regulator 4. The regulator detector 17*a* includes a reflective photosensor and also serves to detect lateral edges of the medium 10 in the width direction, so that the regulator detector 17*a* can be referred also as a media sensor 17*b* in the description related to a second embodiment.

Figure 3:
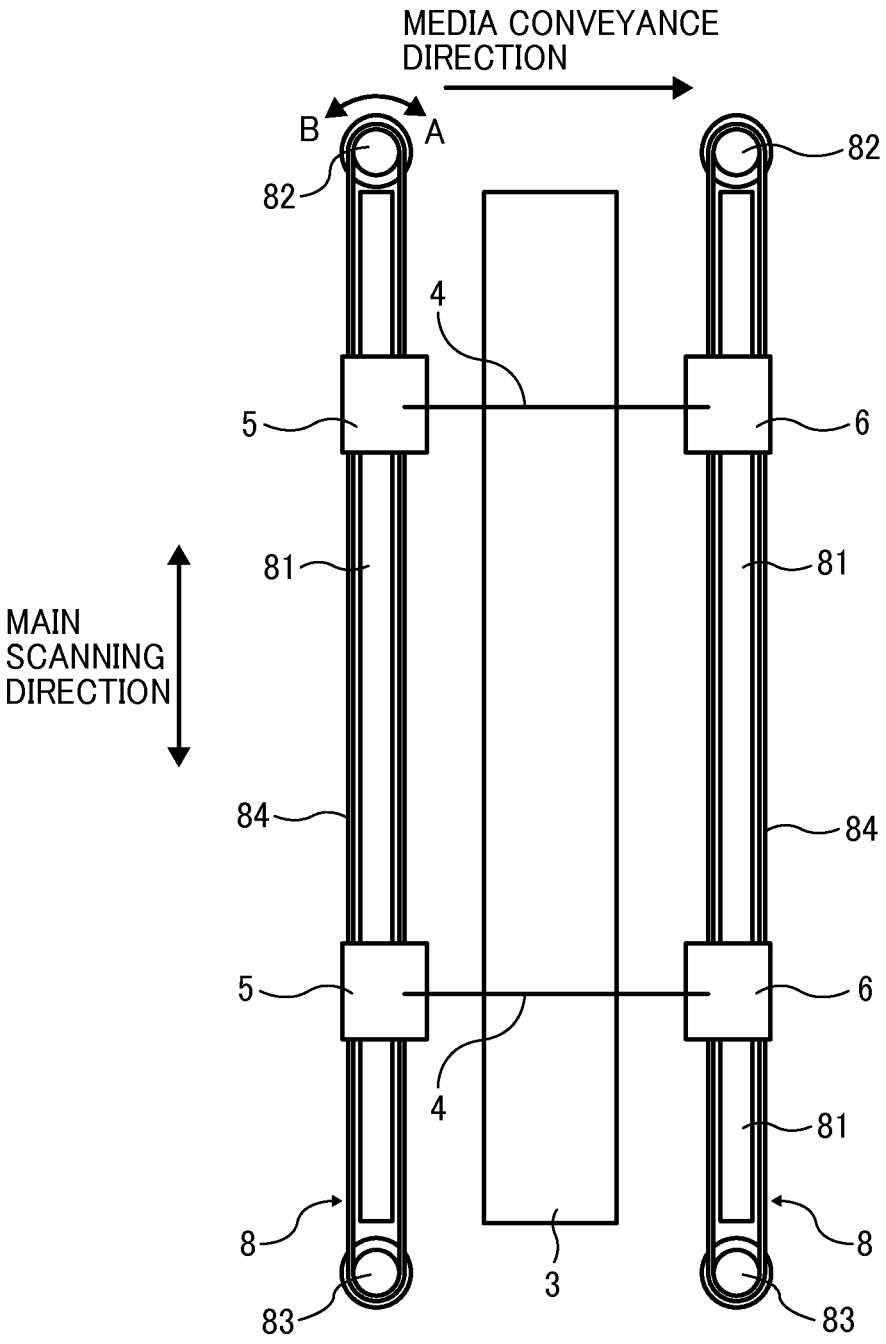
FIG. 3 is an explanatory plan view of a drive unit to move a regulator of the image forming apparatus.

FIG. 3 is a plan view of a part related to the drive unit to drive the regulator. Drive units 8 provided at the upstream and downstream supporters move the upstream supporter 5 and the downstream supporter 6 in the main scanning direction perpendicular to the media conveyance direction.

Each of the drive units 8 include a guide rail 81 to guide the upstream supporter 5 and the downstream supporter 6, a timing belt 84 wound around pulleys 82, 83, and a drive source to rotatably drive the pulley 82. The upstream supporter 5 or the downstream supporter 6 is contacted against the timing belt 84. Herein, as a drive source, a motor to rotatably drive the conveyance roller 21 is employed. The rotation of the motor is transmitted to the pulley 83 via a clutch device.

Herein, the upstream supporter 5 and the downstream supporter 6 are provided in pairs to regulate lateral edges of the medium 10. Further, each of the two upstream supporters 5, 5 contacts a different surface of the loop-shaped timing belt 84. Similarly, each of the two downstream supporters 6, 6 is contacted against a different surface of the loop-shaped timing belt 84.

Thus, the two upstream supporters 5, 5 move to a direction away from each other due to a rotation of the timing belt 84 in one direction (for example, in a direction indicated by an arrow A). In addition, the two upstream supporters 5, 5 move to a direction approaching to each other due to a rotation of the timing belt 84 in the other direction (for example, in a direction indicated by an arrow B). The two downstream supporters 6, 6 move similarly to the above.

With the upstream and downstream supporters 5, 6 configured as above, when the drive unit 8 moves the upstream supporter 5 and the downstream supporter 6, the regulators 4, 4 can be moved to predetermined positions in accordance with the width of the medium 10.

Meanwhile, the drive unit can employ feed screws and ball screws. As a motor, a drive source to directly move the supporters 5, 6 such as a linear motor can be employed.

Figure 4:
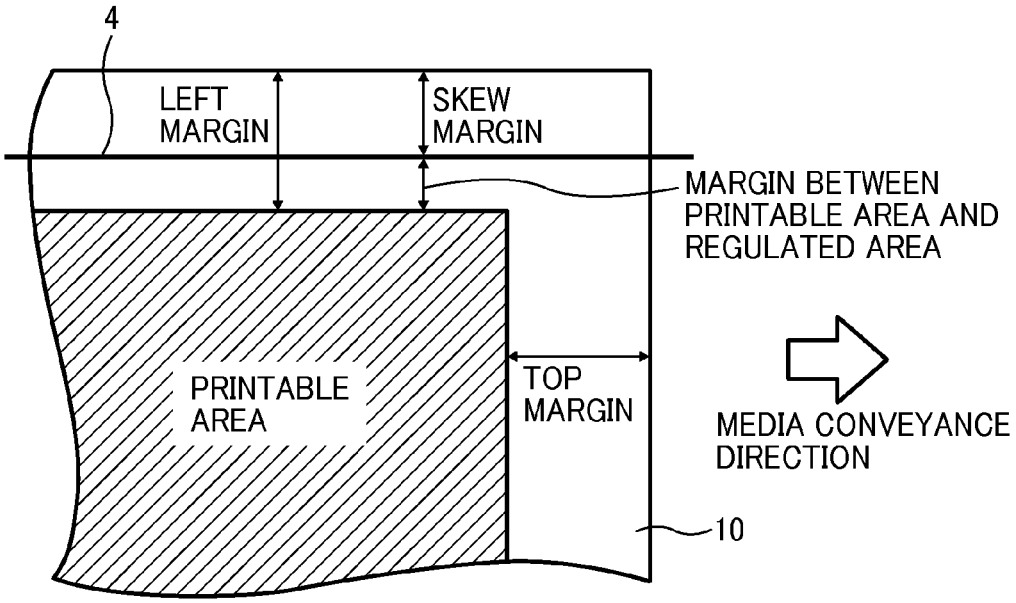
FIG. 4 is an explanatory view illustrating how the regulator operates.

Next, operation and effect of the thus-configured drive units 8 according to the present embodiment will be described with reference to FIG. 4. FIG. 4 is an explanatory view of an effect of the drive unit 8.

In the above embodiment, a position of the regulator 4 is detected by the regulator detector 17*a* mounted to the carriage 12. On the other hand, a position of the carriage 12 is detected by the linear encoder 13 serving as a carriage position detector, and the recording head 11 discharges droplets depending on the position of the carriage 12, thereby forming an image.

Herein, when the image is formed on the medium 10, a start position and an end position of the printable area extending laterally across the medium 10 are determined by the carriage position. On the other hand, because the carriage 12 includes the regulator detector 17*a* to detect the regulator 4, the carriage position when the regulator detector 17*a* detects the regulator 4 can be obtained. That is, the position of the regulator 4 is a proxy for the carriage position. Therefore, because the image forming position and the position of the regulator 4 can be obtained as the carriage position, relative distance between the printable area and the regulator 4 can be properly ascertained. Based on the recognized relative position, the regulator 4 is moved and positioned, so that the position of the regulator 4 relative to the printable area can be controlled with higher accuracy.

As illustrated in FIG. 4, a margin of the medium 10 in the width direction is a distance between a maximum printable area when the regulator 4 presses against the medium 10 and an edge of the medium 10 placed at an ideal position of the medium 10, and is normally several millimeters.

In addition, a margin between the printable area and the regulator 4 is a distance between the printable area when the regulator 4 presses the medium 10 and the regulator 4. Further, a skew margin means a distance between an edge of the medium 10 placed at an ideal position and the regulator 4.

When tolerances are expected in the detection of the regulator 4 and the printable area, if the regulator 4 overlaps the printable area, printing on the overlapped area is prevented by the regulator 4, thereby degrading the image quality. Accordingly, the margin between the regulator and the printable area needs to be set to offset the prospective maximum tolerance.

Herein, because the side margin is defined by a standard, as the margin between the regulator and the image increases, the skew margin decreases correspondingly. If the skew margin decreases, the edge of the medium 10 tends to come off from the regulator 4 because the position of the medium 10 in actuality deviates from the ideal position. If the edge of the medium 10 deviates from the regulator 4, because the medium 10 is not pressed by the regulator 4, the medium 10 contacts the recording head 11, resulting in degradation of the formed image quality and occurrence of a paper jam.

Then, as described above, the position of the regulator 4 is detected by the regulator detector 17*a* and a relative distance between the printable area and the regulator 4 is properly detected from the carriage position, thereby positioning the regulator 4 relative to the medium 10 highly accurately.

Because the regulator 4 can be positioned with high accuracy, the regulator 4 can be positioned near the printable area with a reduced margin between the regulator 4 and the image, thereby maximizing the skew margin and preventing image degradation and occurrence of a paper jam.

Figure 5:
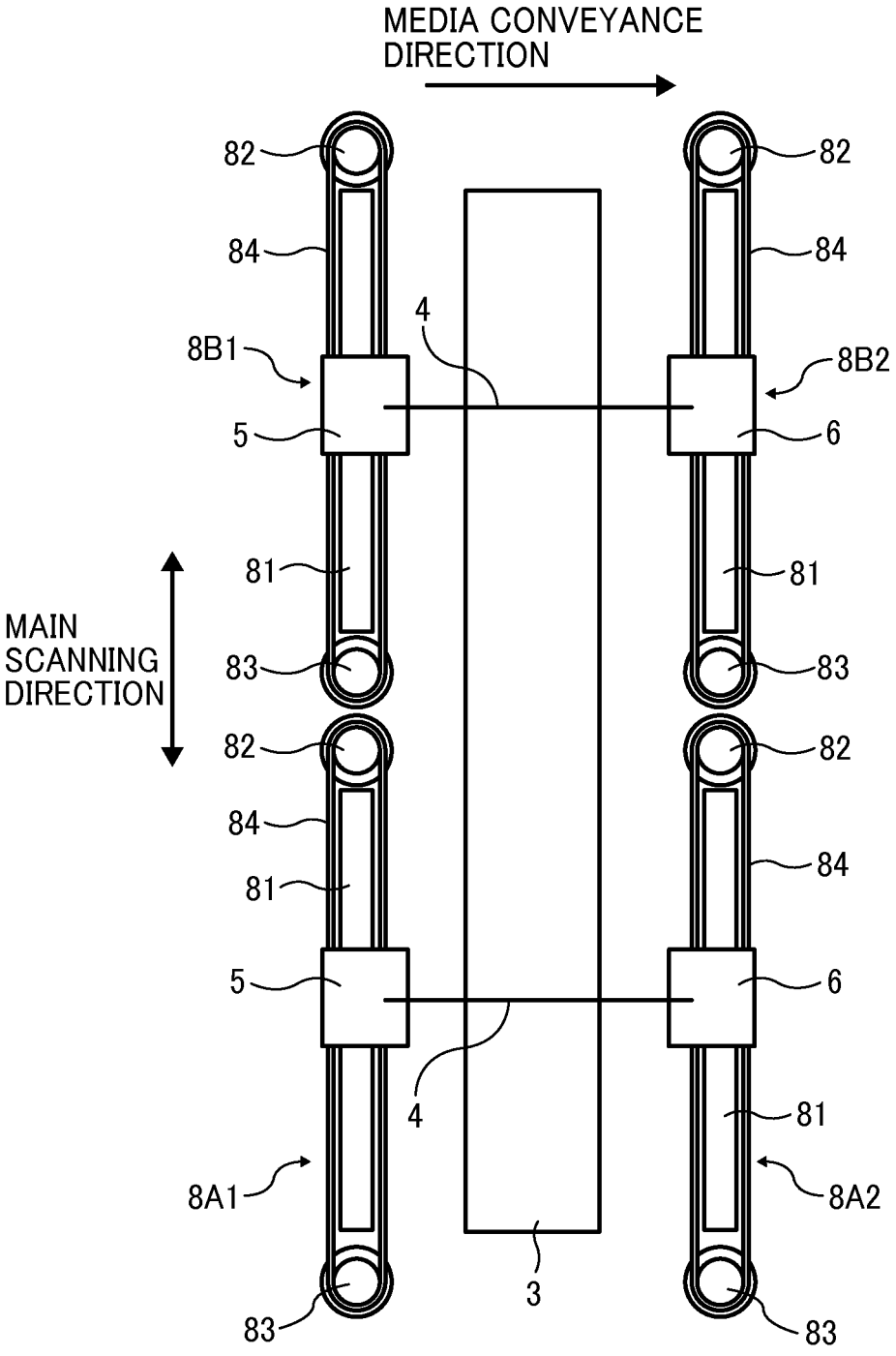
FIG. 5 is a plan view of another exemplary drive unit to move the regulator according to a second embodiment of the present invention.

Next, another drive unit to move the regulator according to a second embodiment will be described referring to FIG. 5. FIG. 5 is a plan view of a part related to the drive unit to drive the regulator.

Drive units 8A1, 8A2, 8B1, and 8B2 move the upstream supporters 5 and the downstream supporters 6 independently in the main scanning direction perpendicular to the media conveyance direction. Further, in the description below, the drive units 8A1, 8A2 can be non-discriminatorily referred to as the drive unit 8A, the drive units 8B1, 8B2 can be non-discriminatorily referred to as the drive unit 8B, and the drive units 8A, 8B can be non-discriminatorily referred to as the drive unit 8.

Each of the drive unit 8 includes a guide rail 81 to guide the upstream supporter 5 or the downstream supporter 6, a timing belt 84 wound around pulleys 82, 83, and a drive source to rotatably drive the pulley 83. The upstream supporter 5 or the downstream supporter 6 is contacted against the timing belt 84.

With this structure, when the pulley 83 of each drive unit 8 is driven to rotate, the two upstream supporters 5, 5 and the two downstream supporters 6, 6 each are movable independently in the carriage moving direction.

In this case, if each pulley 83 of the drive unit 8A is moved at the same driving amount, the regulator 4 moves in parallel. By contrast, if each pulley 83 of the drive unit 8A is moved with a different driving amount, the regulator 4 moves obliquely. The same stands for the drive unit 8B.

Specifically, in the present embodiment, the regulator 4 is supported by the supporter 6 with a tension, so that the tensioner 61 absorbs the tension even though the regulator 4 moves slightly obliquely. With this structure, the regulator 4 can be obliquely positioned in accordance with an amount of skew.

Thus, by controlling the rotation of the pulley 83 by the drive unit 8, each regulator 4 supported by each upstream supporter 5 and downstream supporter 6 can be independently moved in the carriage moving direction. With the upstream and downstream supporters 5, 6 configured to move as above, each of the regulators 4, 4 can be moved to predetermine positions in accordance with the width edge of the medium 10.

A movement of the regulator 4 can be obtained by detecting the rotation amount of the drive source by a rotary encoder. In addition, the position of the regulator 4 can be obtained by a carriage position when a media sensor 17*b* detects the regulator 4.

Similarly to the first embodiment, the drive unit can employ feed screws and ball screws. As a motor, a drive source to directly move the supporters 5, 6 such as a linear motor can be employed.

Next, operation and effect of the thus-configured drive unit 8 according to the present embodiment will be described with reference to FIGS. 6A and 6B, which are explanatory views of an effect of the drive unit 8.

When the medium 10 is moved to the image forming position by the recording head 11, deviation occurs due to errors of the conveyance unit and types of the media. For example, there are cases in which the medium 10 is conveyed to a place as indicated by a solid line or to another place indicated by a broken line in FIG. 6A.

In the present embodiment, the media sensor 17*b* disposed on the carriage 12 detects lateral edges of the medium 10, and the two regulators 4, 4 are movable in the carriage moving direction independently.

Figure 6A:
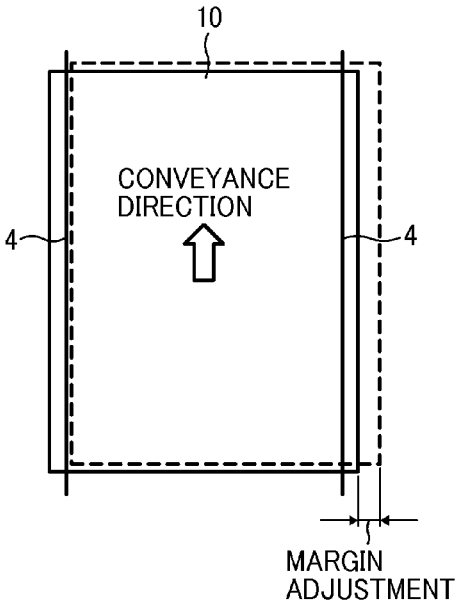
FIGS. 6A and 6B are explanatory views illustrating how the regulator operates.

Accordingly, as illustrated in FIG. 6A, each regulator 4 is caused to move in accordance with the lateral edges of the medium 10, thereby adjusting a margin between the lateral edges of the medium and the regulator 4.

With this structure, the regulator 4 can be positioned relative to the lateral edges of the medium 10 with high precision.

Figure 6B:
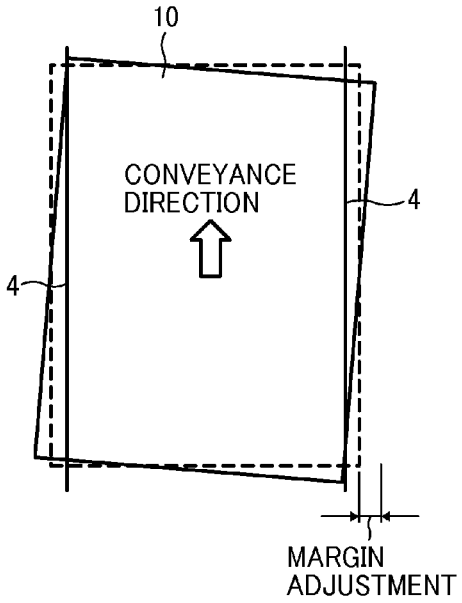

Further, as illustrated in FIG. 6B, there is a case in which the medium 10 is skewed in the conveyance.

In this case, as described above, the media sensor 17*b* detects lateral edges of the medium 10 in the width direction each time the carriage 12 scans to move, the regulator 4 is caused to move to the carriage moving direction independently, and a margin between the lateral edges of the medium and the regulator 4 is adjusted to a predetermined amount.

With this structure, even when the medium 10 is skewed, the regulator 4 can be positioned relative to the edge of the medium 10 with a high precision to securely press down the medium 10, so that image formation can be done while reliably conveying the medium 10.

Figure 7:
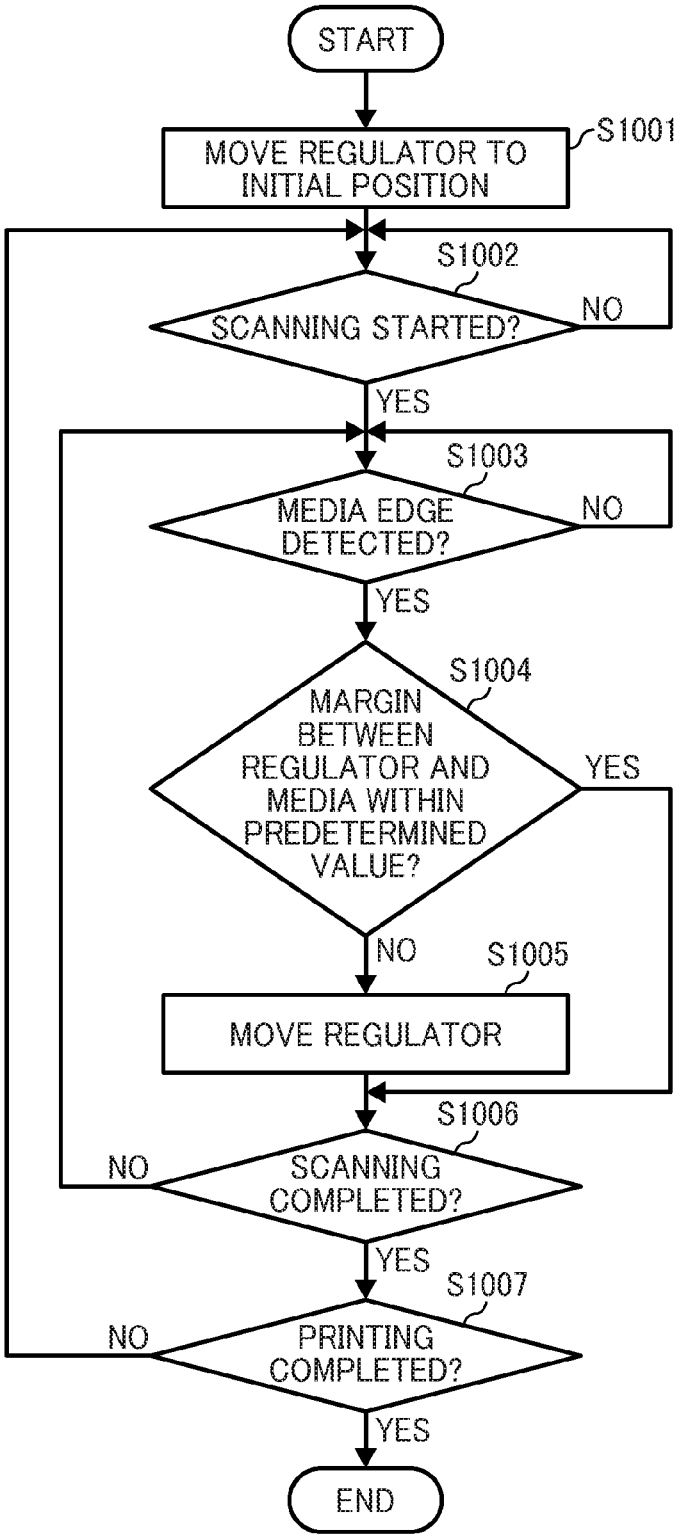
FIG. 7 is a flow chart illustrating control of the movement of the regulator.

Next, a first exemplary process of control of the movement of the regulator according to the present embodiment will be described with reference to a flowchart in FIG. 7.

Upon receipt of a print command, the regulators 4, 4 each are moved to an initial position (in Step S1001). The initial position is predetermined in accordance with a variation of conveyance specific to the apparatus and a size of the medium, and is stored in a memory.

If a margin position adjustor to adjust a conveyance position of the medium due to difference specific to each device or medium is disposed, positions of the regulators 4, 4 can be determined based on the adjustment amount of the margin position adjustor. The margin position adjuster is configured such that, first, a test pattern is printed, an adjustment amount is determined by a user, and the user inputs the adjustment amount to the target device. The margin position adjuster is controlled by a controller. The adjustment amount is an amount to adjust a position of the medium in the main scanning direction or the carriage moving direction.

In addition, the position of the regulator 4 can be obtained as a carriage position when the carriage 12 is moved and the media sensor 17*b* detects the regulator 4.

Thereafter, it is determined whether or not the carriage 12 starts moving (scanning) (in Step S1002), and if scanning starts (Yes in S1002), it is determined whether or not the media sensor 17*b* detects an edge of the medium 10 in the width direction (S1003).

If the lateral edges of the medium 10 is detected (Yes in S1003), it is determined whether or not the margin between the regulator 4 and the lateral edges of the medium 10 is within a predetermined amount (S1004).

In this case, when the margin between the regulator 4 and the lateral edges of the medium 10 is not within a predetermined amount (No in S1004), the regulator 4 is moved so that the margin falls within the predetermined amount (S1005). However, moving of the regulator 4 is omitted when the position of the regulator does not overlap the printable area even though the margin is not within the predetermined amount.

Then, whether or not scanning is complete is determined (S1006).

If the scanning is not complete (No in S1006), the process returns to a determination whether or not the media sensor 17*b* detects an edge of the medium 10 in the width direction (S1003).

With this process flow, lateral edges of the medium 10 in the width direction are detected, and the regulator 4 is positioned such that the distance between the regulator 4 and the lateral edges of the medium 10 falls within a predetermined margin.

Further, because the size of the medium 10 is recognized, another edge of the medium 10 in the width direction can be calculated from one end thereof in the width direction, and the regulator 4 positioned at the other side can be moved.

Then, when all the scanning is complete (Yes in S1006), it is determined whether or not printing is complete (S1007). If the printing is complete (Yes in S1007), the process ends.

As described above, lateral edges of the medium 10 in the width direction are detected for each scanning movement of the carriage 12, and the regulator 4 is controlled to move such that the distance between the regulator 4 and the lateral edges of the medium 10 falls within a predetermined margin.

With this structure, while positioning the regulator 4 at an edge of the medium 10 with a high precision, the regulator 4 does not come off from the medium 10, so that image formation can be done while reliably conveying the medium 10.

Figure 8:
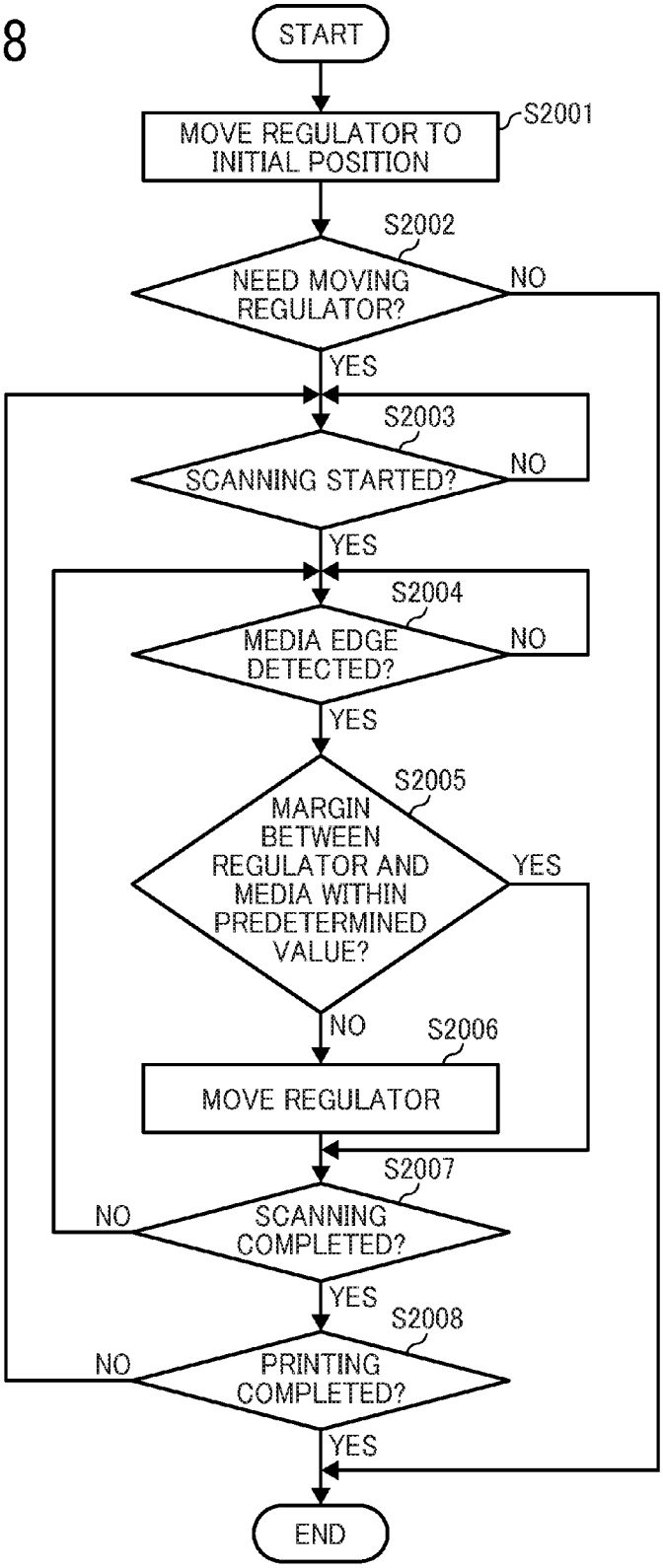
FIG. 8 is a flowchart showing steps in a process of controlling the movement of the regulator according to the second embodiment of the present invention.

Next, a second exemplary process of control of the movement of the regulating member according to the present embodiment will be described with reference to a flowchart of FIG. 8.

Upon receipt of a print command, the regulators 4, 4 each are moved to an initial position (in Step S2001). The operation in Step S2001 is identical to the control according to the above-described embodiment.

Then, whether or not moving control of the regulator 4 is necessary or not is determined (S2002). The determination whether the moving control is necessary or not is based on the determination whether or not the shifted amount of the regulator 4 is greater than the predetermined shift amount for the position of the regulator 4.

Specifically, depending on the relative position of the regulator 4 compared to the size of the medium 10, an allowance of the conveyance error of the medium 10 in the width direction changes. By contrast, when an enough allowance is provided for the prospected conveyance error and the printable area is small, there is no need of controlling moving of the regulator 4. If the moving of the regulator 4 is controlled, a reciprocal moving distance of the carriage for detecting the lateral edges of the medium 10 unnecessarily lengthens, thereby decreasing the productivity. Then, whether or not moving control of the regulator 4 is necessary is determined (S2002).

When it is determined that the moving control of the regulator 4 is necessary, it is determined whether or not the carriage 12 starts moving (scanning) (in Step S2003), and if scanning starts (Yes in S2003), it is determined whether or not the media sensor 17*b* detects an edge of the medium 10 in the width direction (S2004).

If the lateral edges of the medium 10 is detected (Yes in S2004), it is determined whether or not the margin between the regulator 4 and the lateral edges of the medium 10 is within a predetermined allowance range (S2005).

In this case, when the margin between the regulator 4 and the lateral edges of the medium 10 is not within a predetermined allowance range (No in S2005), the regulator 4 is moved so that the margin falls within the allowance range (S2006). By determining whether or not within the allowance range, moving of the regulator 4 can be reduced.

Then, whether or not scanning is all complete is determined (S2007).

If the scanning is not complete (No in S2007), the process returns to a determination whether or not the media sensor 17*b* detects an edge of the medium 10 in the width direction (S2004).

Then, when all the scanning is complete (Yes in S2007), it is determined whether or not printing is complete (S2008). If the printing is complete (Yes in S2008), the process ends.

With this structure, similarly to the first moving control, even when the medium 10 skews, the regulator 4 can be positioned relative to the edge of the medium 10 with a high precision to securely press down the medium 10, so that image formation can be done while reliably conveying the medium 10.

Herein, a difference of the control performed by the first moving control and the second moving control will be described.

If the to-be-printed image does not exceed the margin of the medium 10, the regulator 4 does not need to avoid the image and can be positioned at a position serving as a biasing member simply. In this case, the position of the regulator 4 depends on the type of the medium, printable area and image ratio (that is, an expected cockling amount and range of the medium), size of the medium, temperature and humidity, and the like. Further, if the regulator 4 is positioned relative to the medium with an enough allowance more than the shift amount of the medium, the regulator 4 need not be moved.

However, in the first moving control, the edge of the medium is detected with no exception, and the regulator 4 is controlled to be moved. By contrast, in the second moving control, when the regulator 4 is positioned with an enough allowance, the edge of the medium need not be detected and the carriage moving range is determined by the printable area alone, and the regulator 4 itself is not moved.

Figure 9:
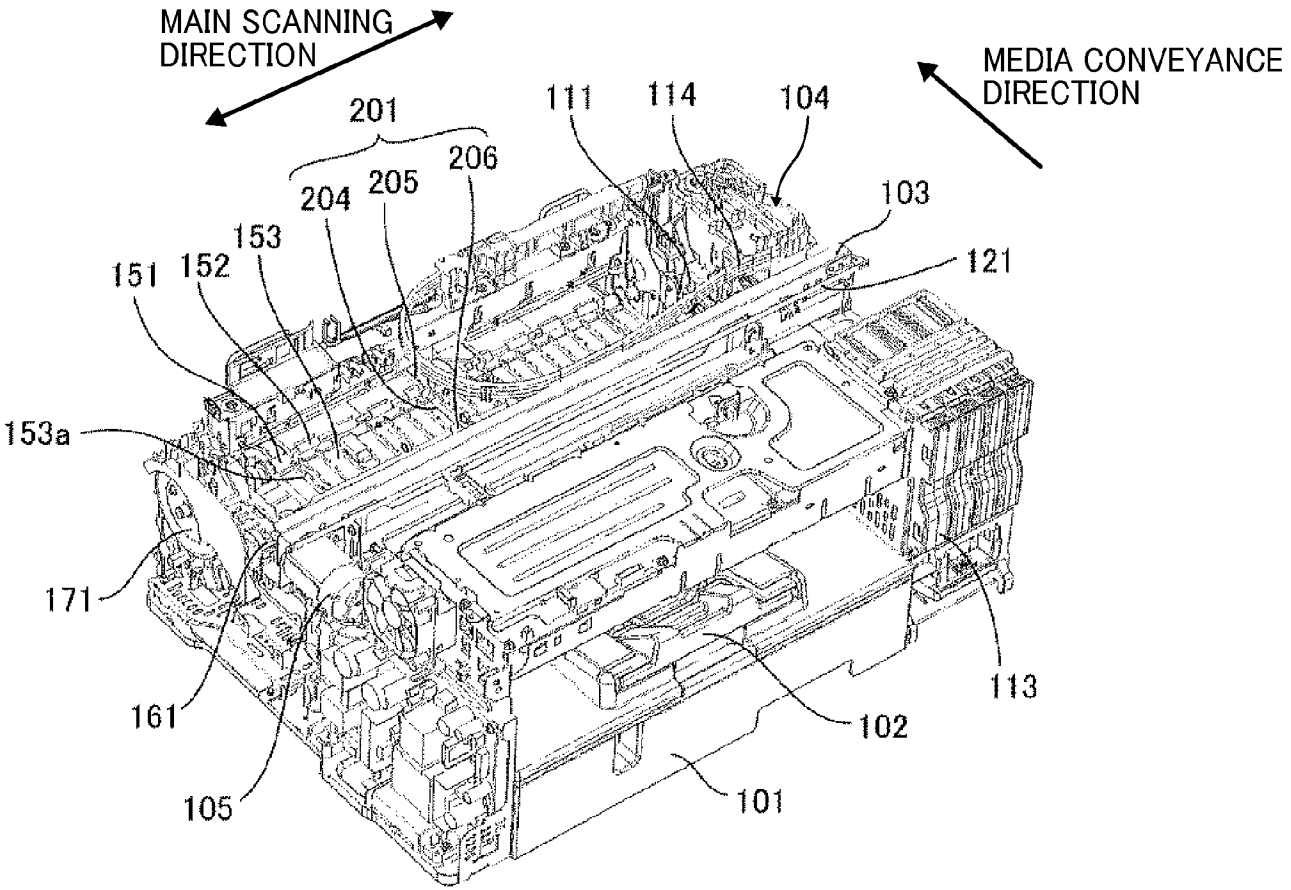
FIG. 9 is a perspective view of an image forming apparatus according to a third embodiment of the present invention.
Figure 10:
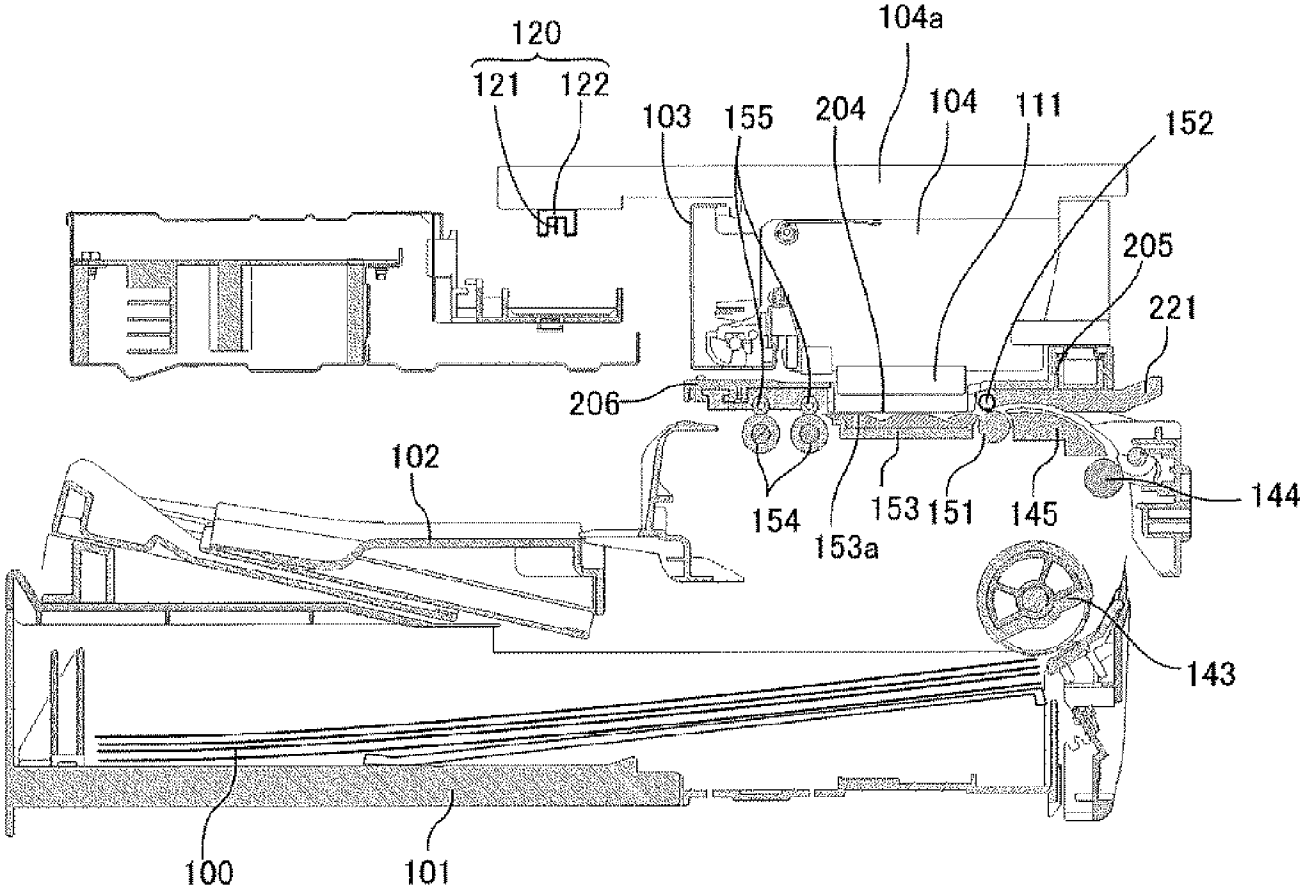
FIG. 10 is an explanatory side view of the image forming apparatus of FIG. 9.

Next, a third embodiment according to the present invention will be described with reference to FIGS. 9 and 10. FIG. 9 is a perspective explanatory view of the image forming apparatus and FIG. 10 is an explanatory side view thereof.

This image forming apparatus is a serial-type image forming apparatus, including a guide member 103 formed of a platelet member laterally supported by side plates, and a carriage 104 which is slidably supported by the guide member 103 to be movable in the main scanning direction perpendicular to the media conveyance direction. The carriage 104 is reciprocally moved by a main scan motor 105. FIG. 9 is a view of the image forming apparatus from which a carriage cover 104*a* as illustrated in FIG. 10 is removed.

A recording head 111 formed of a droplet discharge head to discharge droplets of each color of yellow (Y), cyan (C), magenta (M), and black (K) is mounted on the carriage 104.

Ink of each color is supplied from an ink cartridge 113 as a main supply tank replaceably attached to the main body to the recording head 111 via a supply tube 114.

In addition, an encoder scale 121 is disposed along the moving direction of the carriage 104 and an encoder sensor 122 to read the encoder scale 121 is mounted on the carriage 104. The encoder scale 121 and the encoder sensor 122 constructs a main scanning encoder 120 formed of a linear encoder as a carriage position detector to detect a position of the carriage 104.

At a bottom of the apparatus body, there is provided a paper tray 101 in which a plurality of media 100 is stacked. The media in the paper tray 101 is separated by a feed roller 143 and is conveyed.

Each of the plurality of media 100 sent from the paper tray 101 passes through a relay roller 144 and a conveyance guide plate 145 to a portion between a conveyance roller 151 and a pressure roller 152. Each medium is intermittently conveyed by a conveyance force of the conveyance roller 151 and the pressure roller 152 while being guided by a rib 153*a* of a platen 153.

Herein, the conveyance roller 151 is rotatably driven by a sub-scan motor 161. A sub-scanning encoder 170, described in detail below, is formed of a rotary encoder that includes an encoder wheel 171 and an encoder sensor. The sub-scanning encoder 170 detects a rotation amount of the conveyance roller 151. The sub-scanning encoder 170 serves also as a detector to detect a driving amount of a drive unit 208, described in detail below.

The recording head 111 is driven in response to image signals while moving the carriage 104 to allow the recording head 111 to discharge ink droplets onto the stopped medium 100 to record a single line. After the medium 100 is conveyed by a predetermined amount, a next line is recorded. Upon receiving a recording end signal or a signal indicating that a trailing edge of the medium has reached the recording area, the recording operation is terminated.

A sheet discharge roller 154 and a spur 155 each are disposed in pairs at downstream of the platen 153, so that the medium 100 on which images are formed is discharged onto a paper ejection tray 102.

Figure 11:
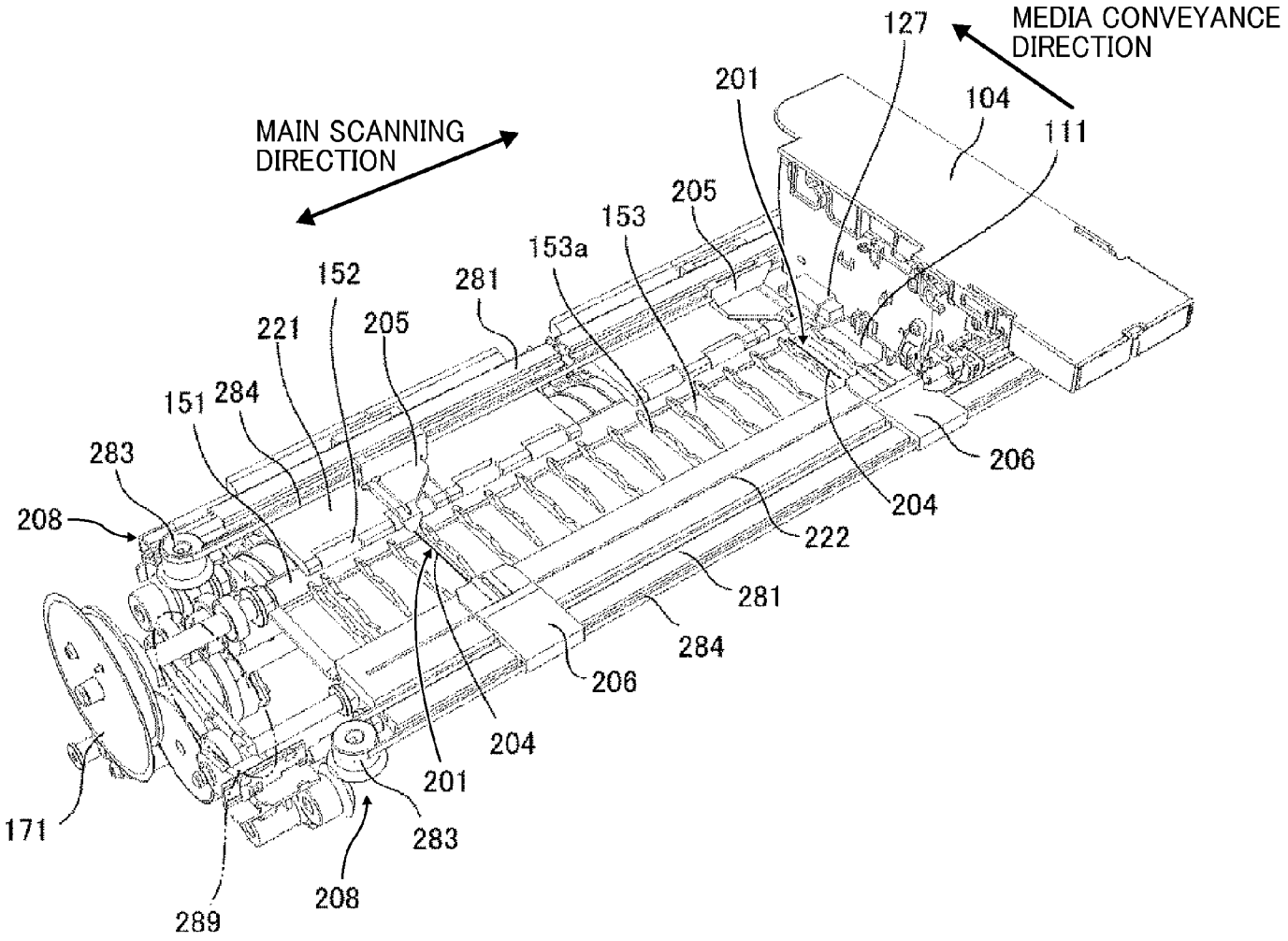
FIG. 11 is a perspective view illustrating a recording portion of the image forming apparatus of FIG. 9.
Figure 12:
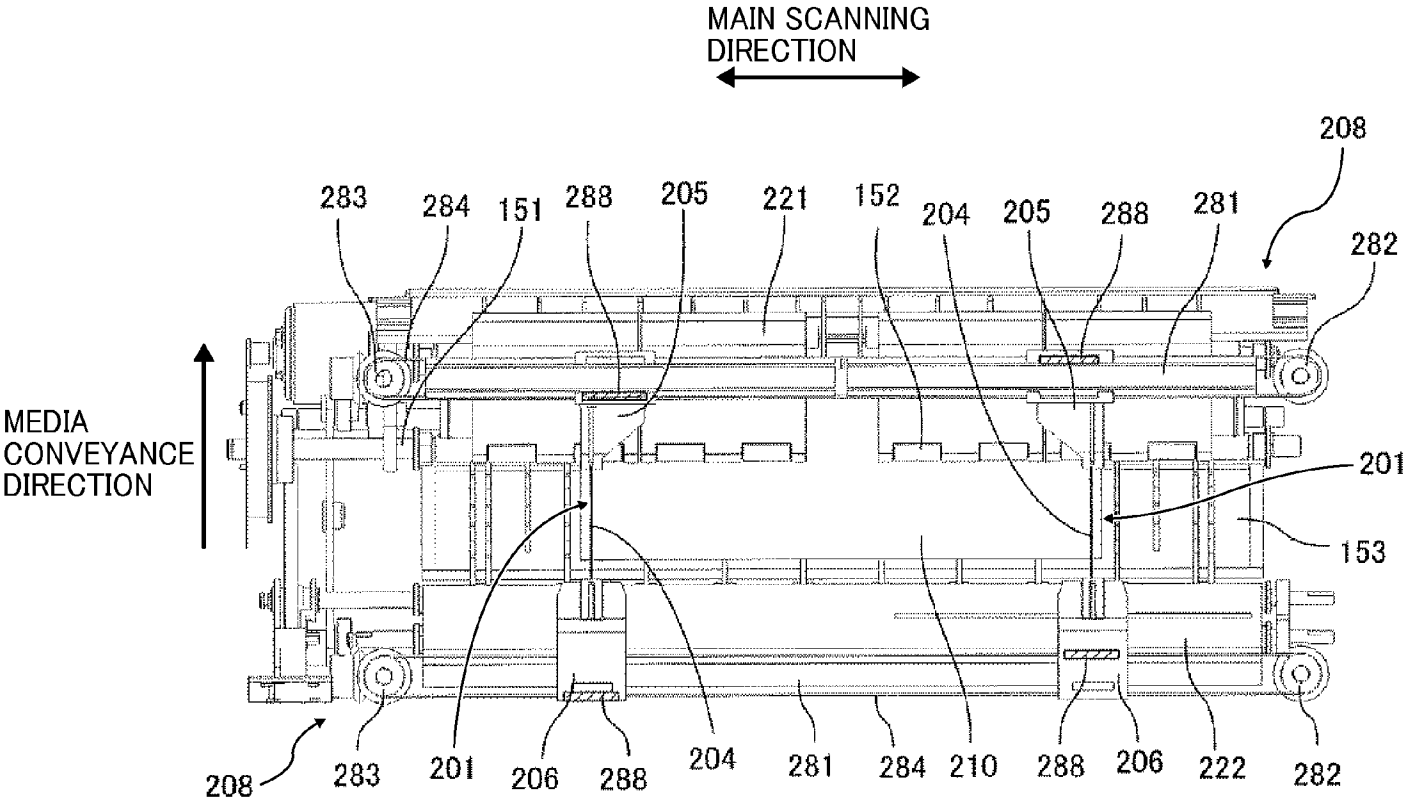
FIG. 12 is a plan view of the recording portion of the image forming apparatus of FIG. 9.

Next, details of a recording section of the image forming apparatus will be described referring to FIGS. 11 and 12. FIG. 11 shows a perspective view of the recording section of the image forming apparatus and FIG. 12 shows a plan view of FIG. 11.

Guide members 201, 201 each to press down the medium 100 are disposed above the platen 153 in the main scanning direction or in the carriage moving direction. Each guide member 201 includes a string-like regulator 204 to contact and press down the medium 100, and holders 205, 206 each to hold the regulator 204. Specifically, both ends of each regulator 204 are held by the holders 205, 206.

The regulator 204 is a thin string-like member with elasticity and is held with tension by two holders 205, 206.

The platen 153 includes a plurality of ribs 153*a* to contact and guide the medium 100, and the regulator 204 is disposed at a higher position than the ribs 153*a*.

The guide member 201 is so disposed as not to contact the carriage 104 and the recording head 111 even when the carriage 104 moves to scan above the platen 153 for printing.

The carriage 104 includes a media sensor 127 formed of reflective photosensor. The media sensor serves also as a regulator detector. Because the media sensor 127 serves also as the regulator detector, the cost can be reduced and the structure can be simplified. The regulator detector can be formed of various sensors using infrared rays, ultrasonic waves, imaging sensors, contact sensors, and the like.

Herein, the drive unit 208 to move the regulator 204 in the main scanning direction will be described.

The drive unit 208 includes guide rails 281 to hold the holders 205, 206 to move in a direction along the scanning direction of the carriage 104. The holders 205, 206 are contacted against a timing belt 284 wound around pulleys 282, 283.

Driving force of the sub-scan motor 161 is transmitted to the pulleys 282, 283 via a drive coupler 289. The drive coupler 289 includes a clutch, so that a transmission of the driving force to the conveyance roller 151 and a transmission and interruption of the drive force to the drive unit 208 can be selectively performed.

The timing belts 284 are disposed upstream and downstream of the platen 153 in the conveyance direction, respectively. The upstream timing belt 284 transmits driving power to the upstream holder 205. The downstream timing belt 284 transmits driving power to the downstream holder 206.

The upstream timing belt 284 and the downstream timing belt 284 are configured to be synchronized, and accordingly, the upstream holder 205 and the downstream holder 206 move in synchronization.

As described above, because the upstream and downstream holders 205, 206 move in synchronization when the guide member 201 including the regulator 204 moves in the main scanning direction, the guide member 201 moves in the scanning direction of the carriage 104 with no slant.

Further, the two holders 205, 205 contacted against the upstream timing belt 284 are secured at a different side of the loop-shaped timing belt 284 by a stationary part 288, respectively. Similarly, the two holders 206, 206 contacted against the downstream timing belt 284 are secured at a different side of the loop-shaped timing belt 284 by a stationary part 288, respectively.

Accordingly, when the timing belt 284 rotates, the two guide member 201 rotate in a direction opposite to each other in the scanning direction of the carriage 104. With this structure, the two guide members 201 move constantly symmetrically to each other with the widthwise center of the platen 153 as a center.

In printing, the controller reads out a size of the medium 100 from printing data sent from a host computer, and moves the guide members 201, 201 in accordance with the size of the medium 100 in the width direction.

The guide members 201, 201 are moved to position inside each lateral edge of the medium 100 in the width direction perpendicular to the conveyance direction of the medium 100 conveyed to the platen 153. With this structure, when the medium 100 is conveyed to the platen 153, lateral edges of the medium 100 each are pinched by the platen 153 and the regulators 204, 204 of the guide members 201, 201.

Thus, the regulator 204 of the guide member 201 can press down the medium 100. Specifically, even when the medium 100 with a floating end portion due to any break or fold is conveyed, the regulator 204 of the guide member 201 regulates the position of the medium 100 to a position not disturbing the carriage 104 and the recording head 111.

With this structure, any inconvenience due to the contact of the medium with the carriage 104 and the recording head 111 such as a skew and a jam can be prevented.

Figure 13A:
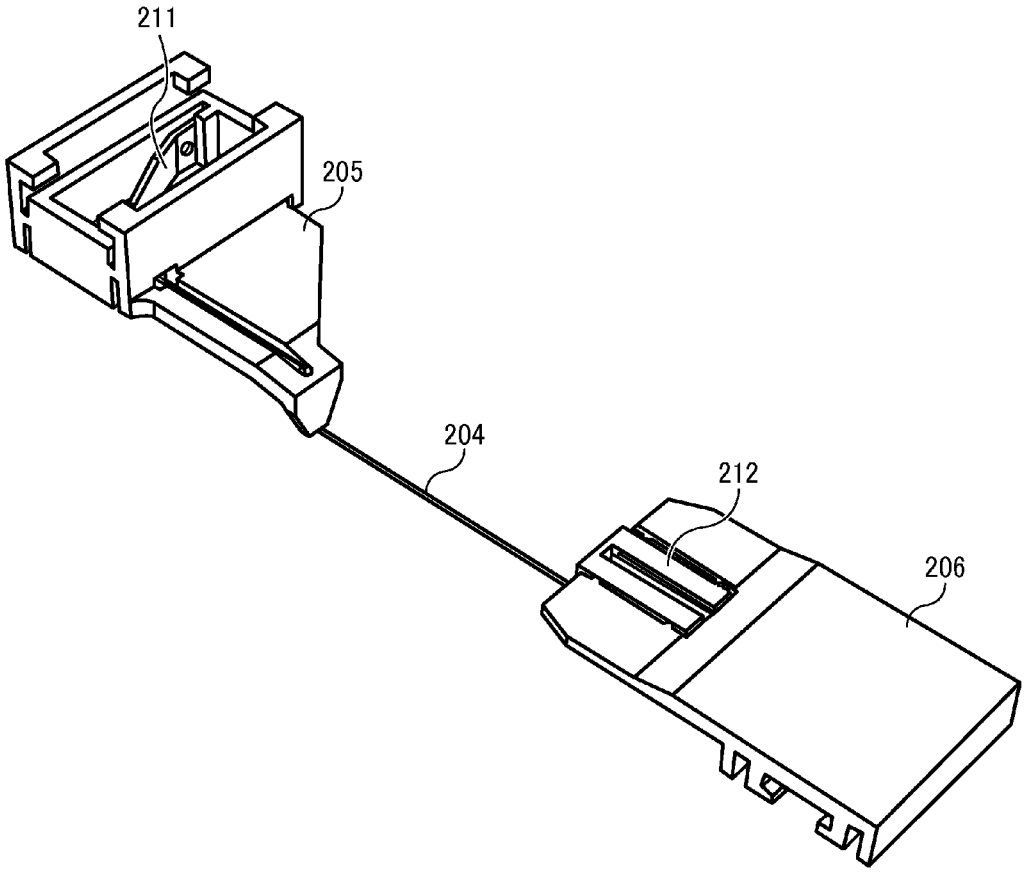
FIGS. 13A and 13B are perspective views of a guide member.
Figure 13B:
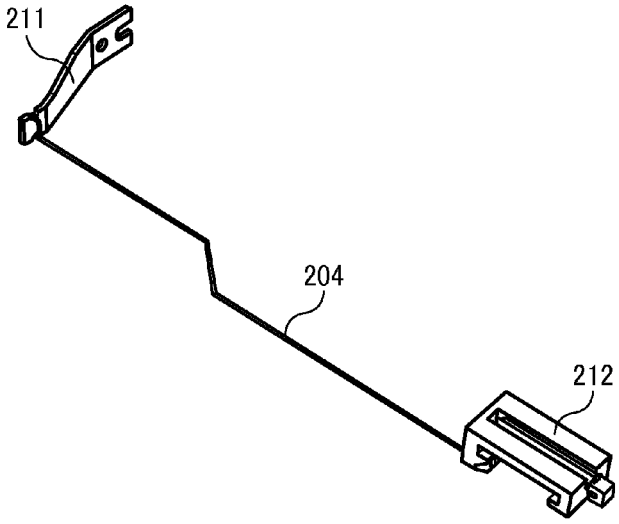

Next, the guide member 201 will be described in more detail referring to FIGS. 13A and 13B. FIG. 13A is a perspective view of a guide member. FIG. 13B is a perspective view of the regulator 204 to show a holding state.

The upstream holder 205 includes a plate spring 211, and one end of the regulator 204 is supported by the holder 205 via a plate spring 211. The other end of the regulator 204 is loop-shaped. The loop-shaped portion is hung on a notch formed on the plate spring 211.

The downstream holder 206 includes a stationary member 212, and the other end of the regulator 204 is supported by the holder 206 via the stationary member 212. The other end of the regulator 204 is also loop-shaped. The loop-shaped portion is hung on a claw disposed on the stationary member 212.

Because one end of the regulator 204 is retained by the holder 205 via the plate spring 211, the regulator 204 is retained with tension. As a result, although the regulator 204 is formed of an elastic material, the regulator 204 is constantly retained with tension. As illustrated in FIG. 13A, the holders 205, 206 are retained such that a distance between the holders 205, 206 is minimum.

In addition, one end of the regulator 204 is held by the plate spring 211, which allows the regulator 204 to be deformed at a certain degree.

Herein, for example, when the medium stops on the platen 153 due to some reason during printing, the user needs to remove the medium on the platen 153. As described above, because the regulator 204 is formed of an elastic material so that a certain deformation is allowable, the medium stopped on the platen 153 can be removed without damaging the regulators 204, 204 and the holders 205, 206.

Figure 14:
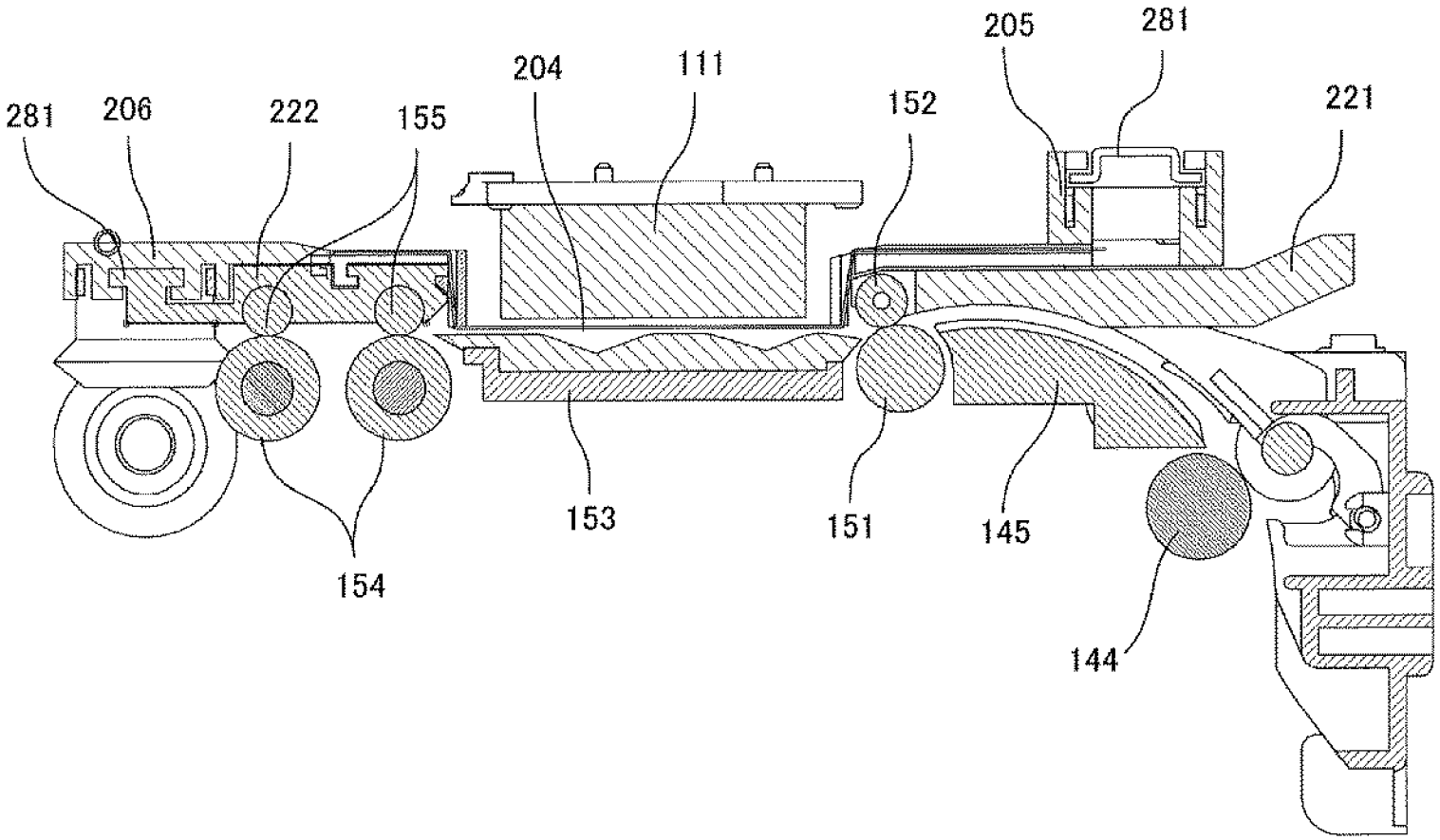
FIG. 14 is an explanatory side view illustrating a position of the guide member.

Next, positioning of the guide member 201 will be described referring to FIG. 14. FIG. 14 shows an explanatory side view illustrating the guide member 201.

The conveyance roller 151 and the pressure roller 152 to send the medium 100 onto the platen 153 are disposed upstream of the platen 153 in the media conveyance direction. Sheet discharge rollers 154 and spurs 155 to further send the medium 100 sent from above the platen 153 to a sheet discharge tray 102 are disposed downstream of the platen 153 in the media conveyance direction.

The pressure roller 152 is supported by the apparatus body via a pressure plate 221. The spurs 155 are supported by the apparatus body via a spur holder 222.

Then, lateral edges of the regulator 204 each are supported by the upstream holder 205 disposed above the pressure plate 221 and the downstream holder 206 disposed below the spur holder 222, respectively, so that the upstream holder 205 is movably supported by the guide rail 281 held by the apparatus body. The downstream holder 206 is movably supported by the guide rail 281 disposed on the spur holder 222 held by the apparatus body.

A leading end of each of the holders 205, 206 extends to a proximity of the platen 153 so as to cover from an upper surface of the pressure plate 221 and the spur holder 222 to an end of the platen 153. The elastic regulator 204 is disposed to pass through a gap between the recording head 111 and the platen 153 on the platen 153 along the shape of the holders 205, 206.

Because the regulator 204 and the holders 205, 206 are configured as such, the regulator 204 and the holders 205, 206 are arbitrarily movable in the main scanning direction. The regulator 204 and the holders 205, 206 can be positioned outside the scanning area of the recording head 111 and do not disturb moving of the recording head 111.

The regulator 204 alone is disposed between the platen 153 and the recording head 111, and the regulator 204 employs a string-like member, so that a depth of the apparatus can be reduced compared to other regulators with a similar function formed of a sheet metal. With this structure, an increase in the distance between the platen and the recording head by adding the regulator can be suppressed, thereby obtaining an optimal image by the liquid discharging recording method.

Figure 15:
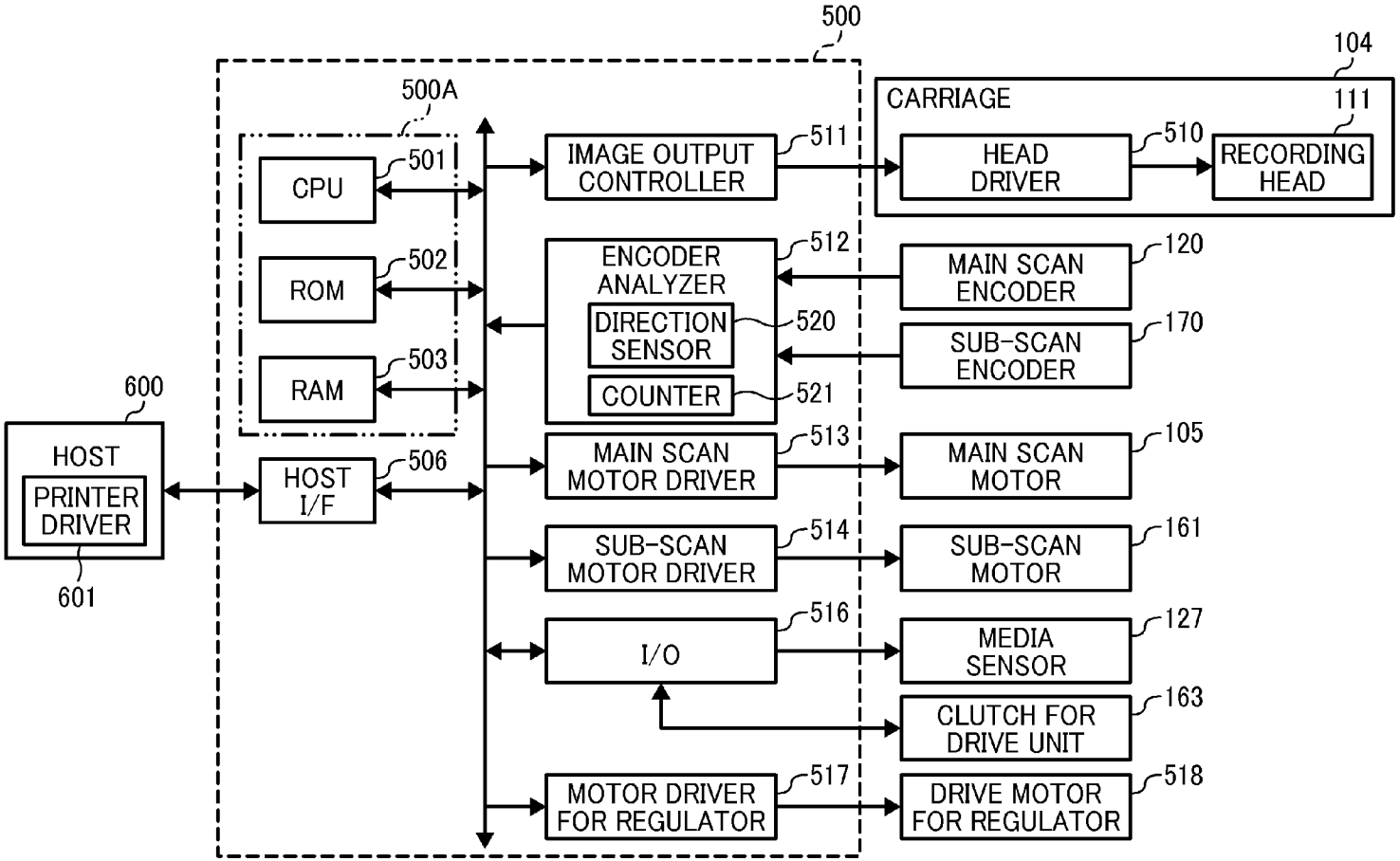
FIG. 15 is a block diagram illustrating a general outline of a controller of the image forming apparatus.

Next, an outline of a controller in the image forming apparatus will be described with reference to FIG. 15. FIG. 15 is a block diagram of a controller 500.

The controller 500 includes a main controller 500A including: a CPU 501 to control the apparatus entirely; various programs performed by the CPU 501; a read-only memory (ROM) 502 storing various fixed data; and a random access memory (RAM) 503 to temporarily store image data. The main controller 500A performs various controls on position detection of the regulator 204, positioning, and detection of the carriage position.

The controller 500 further includes a host I/F 506 to transmit data to and from a printer driver 601 of a host computer 600 such as a PC; an image output controller 511 to control driving of the recording head 111; and an encoder analyzer 512. The encoder analyzer 512 receives detection signals from the main scanning encoder 120 and the sub-scanning encoder 170 and analyses them, thereby detecting the carriage position and a conveyance amount (that is, a rotation amount of the conveyance roller 151).

The controller 500 further includes a main scan motor driver 513 to drive the main scan motor 105; a sub-scan motor driver 514 to drive the sub-scan motor 161; various sensors (including a media sensor 127) and actuators; and an I/O 516 to transfer data with the various sensors (including a media sensor 127) and actuators.

The image output controller 511 includes a data generator to generate print data, a driving waveform generator to generate a driving waveform to control driving of the recording head 111, a data transferrer to transfer a head control signal for selection of a predetermined drive signal from the driving waveform, and the print data.

A head driver 510 is a head driving circuit to drive the recording head 111 mounted on the side of the carriage 104. The image output controller 511 outputs driving waveforms, head control signals, and print data to the head driver 510, to cause the recording head 111 to discharge droplets corresponding to the print data from the nozzles of the recording head 111.

The encoder analyzer 512 includes a direction sensor 520 to detect a moving direction of the carriage 104 from a detected signal and a counter 521 to detect a movement of the carriage 104.

The controller 500 controls driving of the main scan motor 105 via the main scan motor driver 513 based on the analyzing result from the encoder analyzer 512, to control moving of the carriage 104. The main controller 500A drives a motor 518 for the regulator of the drive unit 208, via a motor driver 517 for the regulator, thereby moving the regulator 204. In addition, the main controller 500A controls conveyance of the medium by controlling driving of the sub-scan motor 161 via the sub-scan motor driver 514.

The I/O 516 receives detection signals from the media sensor 127 and from various other sensors. The I/O 516 transfers signals to connect or disconnect a clutch 163 for the drive unit of the drive coupler 289 that connects the drive unit 208 and the sub-scan motor 16.

The main controller 500A detects a position of the regulator 204 from a reading by the media sensor 127 and detects a position of the carriage 104 from a reading by the encoder analyzer 512.

The main controller 500A controls driving of the sub-scan motor 161 and the clutch 163 based on these readings, and moves the regulators 204 via the drive unit 208 to be positioned at lateral edges of the medium 100 in the width direction.

Thus, similarly to the first embodiment, the positions of the regulators 204 are detected by the media sensor 127 and the drive unit 208 positions the regulators 204 at the lateral edges of the medium 100 in the width direction.

Because the position of the regulator 204 as a detection target is detected linked with the carriage position, the position of the regulator 204 can be detected with a higher precision and the regulators 204 can be positioned highly accurately at lateral edges of the medium 100 in the width direction.

Specifically, when the position of the regulator 204 is detected by a driving amount of the drive unit 208 that moves the regulator 204, there is a difference between the target driving amount and an actual move amount due to dimensional errors of the parts and backlash allowance. As a result, the regulators 204 cannot be positioned accurately at widthwise lateral edges of the medium.

Even in a case in which the position of the regulator 204 is directly detected, a relative distance with the printable area (or the image position) is actually required when positioning the regulator 204. Therefore, there is an error in the relative position up to the image position.

With this, the relative error can be minimized by detecting the position of the carriage 104 in the main scanning direction (i.e., the carriage position) and by defining the positional relation of the regulator 204 by the carriage position.

In this case, if the media sensor 127 (or the regulator detector) of the carriage 104 is used each time the position of the regulator 204 is defined, the carriage 104 needs to be moved each time the carriage position is detected, which is not efficient.

Then, at a time of power on, after the regulator detector mounted on the carriage 104 performs a detection once, driving amount of the drive unit 208 to drive the regulator 204 is controlled and modified, so that an accurate positioning control can be performed efficiently.

For example, in the present embodiment, the sub-scanning encode 170 serves also as a driving amount detector, so that a deviation between the target driving amount and an actual movement of the regulator 4 can be obtained from a variation of the carriage position of the regulator 4 when the target driving amount is driven. Then, when the target driving amount is changed by the deviation amount and driven, the regulator 4 can be moved to a proper position.

The driving control to move the regulator 204 is performed by the main controller 500A as described above, the correction control of the driving amount is also performed by the main controller 500A.

If the regulator 204 cannot be detected even though the carriage 104 is moved from one end of the other to directly detect the regulator 204, it can be determined that the regulator 204 is interrupted or broken.

In this case, the failure of the regulator 204 can be notified to the user. The notification can be performed using the control panel of the apparatus body or the printer driver 601 of the host computer 600.

More specifically, when the regulator 4 is broken, the broken regulator 4 may contact the sheet or the recorded medium, thereby causing a paper jam or imaging degradation.

To prevent such an inconvenience, when the break of the regulator 4 is detected, the user is notified of the event and can make the regulator 4 not in operation or replace it.

Further, it is preferable that the regulator 4 be moved outside the width of a sheet or recorded medium to prevent the regulator 4 from contacting the sheet, so that the regulator 4 is unused. As a structure not to shift the regulator 4, for example, a mechanical lock using a claw can be employed when the regulator 4 moves outward exceeding a predetermined width. Alternatively, the regulator 4 can be programmed not to be used.

Figure 16:
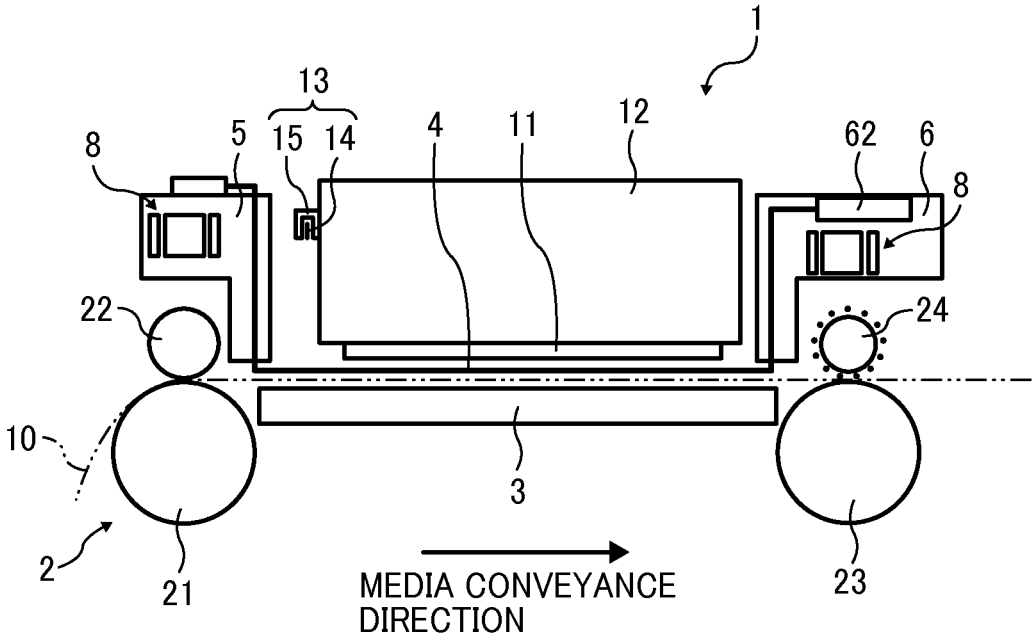
FIG. 16 is a schematic side view of an image forming apparatus according to a fourth embodiment of the present invention.
Figure 17:
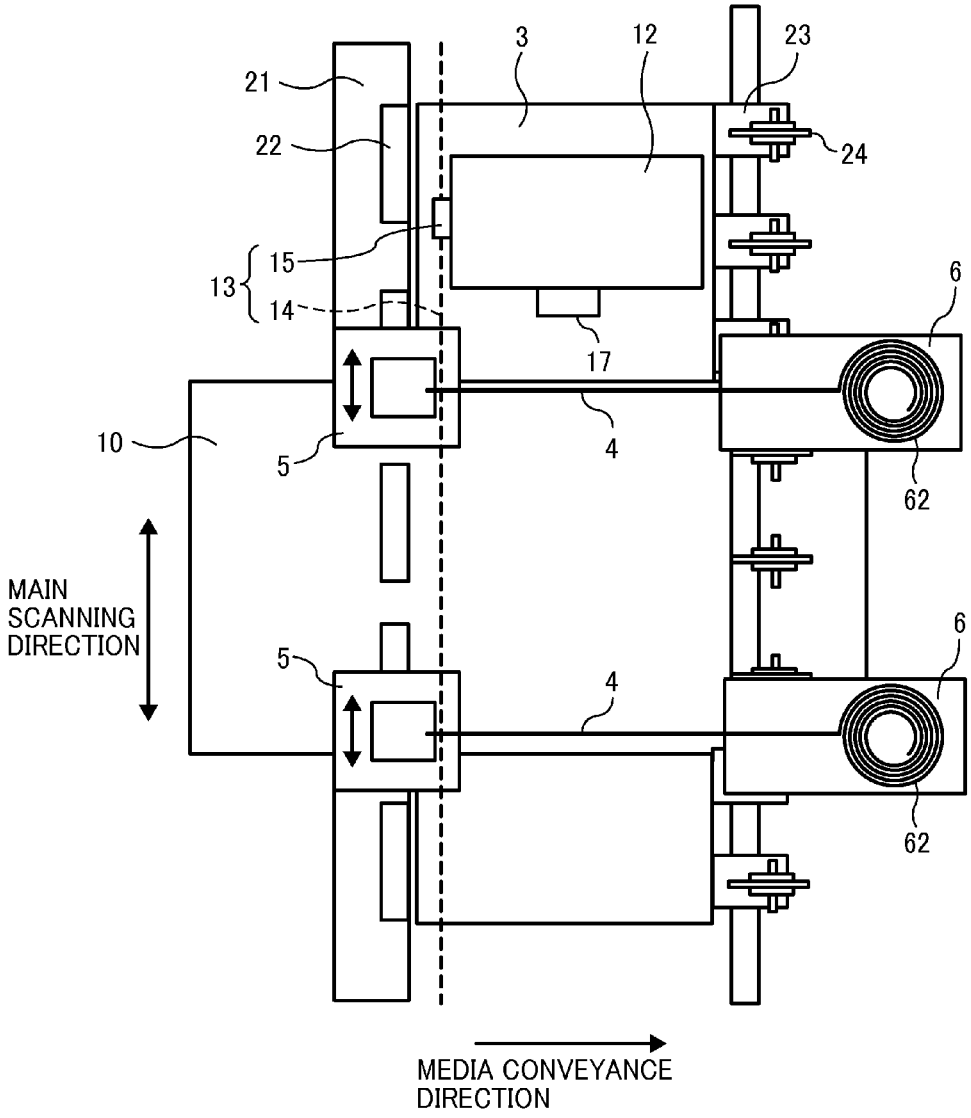
FIG. 17 is an explanatory plan view of the image forming apparatus.

Next, a fourth embodiment according to the present invention will be described with reference to FIGS. 16 and 17. FIG. 16 is a schematic perspective view of an image forming apparatus illustrating a principal part thereof. FIG. 17 is an explanatory plan view of the image forming apparatus of FIG. 16.

In the fourth embodiment, a flat spiral spring 62 is used as a tensioner.

Because the tensioner is thus constructed, if the regulator 204 is broken, the flat spiral spring 62 can collect a cut portion of the regulator 204 nearer to the downstream supporter 6 into it. Accordingly, the flat spiral spring 62 can be disposed at the side of the upstream supporter 5 as well, and the flat spiral spring 62 can collect a cut portion of the regulator 204 nearer to the upstream supporter 5 into it.

With this structure, when the break of the regulator 4 is detected, the regulator 4 can be retracted from the printable area immediately.

In addition, when a mechanism such as a take-up reel to collect the regulator 204 is provided, the regulator 204 can be collected and retracted from the printable area by driving the take-up mechanism.

The term "image formation" means a substantially same matter as meant by recording, printing, image printing, and the like. The term "Image formation" means not only forming images with letters or figures having meaning to the medium, but also forming images without meaning such as patterns to the medium (and simply jetting the droplets onto the medium).

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image forming unit to form an image on a medium;

a reciprocally moving carriage on which to mount the image forming unit;

a carriage position detector to detect a position of the carriage;

a conveyance unit to convey the medium opposing the image forming unit;

a conveyance path of the medium;

a regulator to regulate a distance between the medium and the image forming unit, disposed between the image forming unit and the conveyance path of the medium and movable in a moving direction of the carriage;

a regulator detector, mounted on the carriage, to detect the regulator;

a drive unit to move the regulator; and a controller that controls a position of the regulator based on a reading from the position of the carriage detected with the carriage position detector when the regulator detector detects the regulator.

2. The image forming apparatus as claimed in claim 1, wherein the regulator detector is a media sensor.

3. The image forming apparatus as claimed in claim 1, wherein the controller corrects a driving amount of the drive unit based on a reading from the position of the carriage detected with the carriage position detector when the regulator detector detects the regulator.

4. The image forming apparatus as claimed in claim 1, wherein the controller detects a break of the regulator by a reading from the regulator detector.

5. The image forming apparatus as claimed in claim 4, further comprising a tensioner connected to the regulator to collect the regulator when the controller detects the break of the regulator.

* * * * *